United States Patent [19]

Bisbing

[11] Patent Number: 4,828,298

[45] Date of Patent: May 9, 1989

[54] FLEXIBLE DRAW LATCH

[75] Inventor: Robert H. Bisbing, Springfield, Pa.

[73] Assignee: Southco, Inc., Concordville, Pa.

[21] Appl. No.: 204,933

[22] Filed: May 31, 1988

Related U.S. Application Data

[63] Continuation of Ser. No. 47,263, May 8, 1987, abandoned, which is a continuation-in-part of Ser. No. 928,415, Nov. 7, 1986, abandoned.

[51] Int. Cl.[4] ..... E05C 5/02

[52] U.S. Cl. ..... 292/113; 292/DIG. 38; 292/DIG. 49

[58] Field of Search ..... 292/247, 246, 113, DIG. 38, 292/DIG. 49, 66, 340

[56] References Cited

U.S. PATENT DOCUMENTS

| | | | |
|---|---|---|---|
| 2,028,223 | 1/1936 | Lambert | 292/247 X |
| 2,206,848 | 7/1940 | McAvoy | 292/247 X |
| 2,743,029 | 4/1956 | Mautner | 292/113 X |
| 2,829,912 | 4/1958 | Koch | 292/340 X |
| 3,134,617 | 5/1964 | Slonneger | 292/113 X |
| 3,181,905 | 5/1965 | Bisbing | 292/109 |
| 3,466,076 | 9/1969 | Bisbing | 292/109 |
| 3,490,805 | 1/1970 | Di Pierro et al. | 292/113 X |
| 3,618,995 | 11/1971 | McLean | 292/247 X |
| 4,035,016 | 7/1977 | Ricca | 292/113 X |
| 4,326,739 | 4/1982 | Schlueter | 292/247 |
| 4,428,608 | 1/1984 | Cooke et al. | 292/247 |
| 4,540,206 | 9/1985 | Frame et al. | 292/66 |

FOREIGN PATENT DOCUMENTS 2158144 11/1985 United Kingdom .

OTHER PUBLICATIONS

Southco, Inc. catalogue, pp. HH-1 to HH-8.

*Primary Examiner*—Richard E. Moore
*Attorney, Agent, or Firm*—Paul & Paul

[57] ABSTRACT

A flexible draw latch for use in securing two closure members together comprises a keeper adapted to be affixed to one of the closure members, a mounting bracket adapted to be affixed to the other closure member, a lever pivotally connected to the mounting bracket, and a locking member made of a flexible, resilient material pivotally connected to the lever wherein the locking member is detachably connected to the keeper and wherein the locking member is disposed in overlying relation to the keeper, the mounting bracket and the lever when the latch is in a closed, latched position and wherein the pivot connection between the lever and the locking member is closer to the closure member than the pivot connection between the lever and the mounting bracket when the latch is in a closed, latched position. A cross-pin is transversely disposed within the keeper-engageable portion of the locking member to prevent localized deformation and to relieve stress on the locking member.

17 Claims, 3 Drawing Sheets

FLEXIBLE DRAW LATCH

This application is a continuation of application Ser. No. 047,263, filed May 8, 1987, now abandoned, which is a continuation-in-part of Ser. No. 928,415, filed Nov. 7, 1986, now abandoned.

BACKGROUND OF THE INVENTION

This invention relates generally to over-center draw latches for use in securing two closure members together. More specifically, the present invention relates to over-center draw latches of the flexible or elastic type.

Many types of over-center draw latches are generally known in the art. One such type of over-center draw latch is taught in my U.S. Pat. Nos. 3,181,095, issued May 4, 1965, and 3,466,076, issued Sept. 9, 1969. The latches disclosed in these patents essentially comprise a keeper and a one-piece part having three segments: a base segment, a locking segment, and an intermediate segment wherein the intermediate segment is flexibly connected to the base and locking segments. When in a latched condition, the locking segment is detachably connected to the keeper and is in overlying relation to the keeper, the base segment, and the intermediate segment.

These latches were often considered desirable because they provided positive over-center latching, were lightweight and also were inexpensive to manufacture. Furthermore, these latches were attractive in appearance. Typically, however, these latches were of a molded plastic construction and were incapable of use in situations where high loads were placed on the latch. Another disadvantage in these latches was the fact that considerable precision was required in the installation of the latch and the keeper in order for the latch to operate properly.

Flexible draw latches are also known in the art and have been used for many years. Perhaps the most simple example of a flexible draw latch comprises a mounting bracket, a rubber stretch arm affixed to the bracket, and a keeper. These flexible draw latches are typically used to secure loose fitting hoods or covers on heavy machinery or mechanical equipment. In operation, the rubber stretch arm would be pulled up and into engagement with the keeper, whereby the elasticity of the rubber arm would keep the hood or cover secure. Although these latches were not very pleasing in appearance and did not provide the more positive over-center latching action, they were considered desirable because the flexibility of the rubber arm compensated for misalignment of the bracket and keeper during installation. Another advantage of these flexible draw latches was that the load capability of the latch could be varied, within a range, by simply increasing or decreasing the distance between the bracket and the keeper and, thus, the tension on the rubber stretch arm. In high load situations, this type of latch became impractical, however, because of the difficulty in stretching the heavy-duty rubber arm required in such situations.

Another type of flexible draw latch is also known which was primarily developed to overcome the disadvantages of the above-mentioned flexible latch by providing a lever handle to assist in stretching the rubber arm. Essentially, these lever-assisted flexible draw latches comprise a bracket, a rubber stretch arm, a lever handle and a keeper. The rubber stretch arm is connected at one end to the bracket and connected at the other end to the lever at a point intermediate the ends of the lever. To operate the latch, the lever handle was inserted in the keeper and pivoted to stretch the rubber arm and then seating to secure the latch with a positive over-center action. Despite its advantages over the previous flexible draw latches, however, these lever assisted latches were considered unsightly and their use was essentially limited to high load situations where heavy-duty latches are required.

I have invented a simple draw-pull latch for use in securing two closure members together which provides the advantages of a flexible locking member in an aesthetically pleasing latch which is inexpensive to manufacture, easy to use, and has a wide variety of practical applications.

SUMMARY OF THE INVENTION

Briefly, the present invention comprises a flexible over-center draw latch for use in securing two closure members together, comprising a keeper adapted to be affixed to one of the members, a mounting bracket adapted for being affixed to the other member, a lever pivotally connected to the mounting bracket, and a flexible locking member pivotally connected to the lever. In operation, the locking member is disposed over the keeper and pushed toward the closure member to a latched position overlying the bracket, the keeper and the lever, whereby the latch is secured by a positive over-center latching action. The tail end of the locking member is provided with a concave surface to facilitate the lifting of the locking member to an unlatched position. The nose end of the locking segment is preferably provided with a transverse cross-pin which engages the keeper to prevent localized stress on the flexible locking member when the latch is in its closed position. .

Accordingly, it is a primary object of the present invention to provide a novel flexible draw latch.

It is another object of the present invention to provide a flexible draw latch having positive over-center latching action.

It is another object of the present invention to provide a draw latch having a flexible locking member.

It is a further object of the invention to provide a flexible draw latch having variable load capabilities.

It is another object of the invention to provide a flexible over-center draw latch wherein the flexible locking member is in overlying relation to the rest of the latch components when in the latched condition.

It is a further object of the invention to accomplish the above objects by providing a keeper, a mounting bracket, a lever pivotally connected to the mounting bracket, and a flexible locking member pivotally connected to the lever and having a nose end adapted to receive the keeper.

It is another object of the invention to provide a latch having the above objects wherein the nose end of the latch is provided with a transverse cross-pin which engages the keeper to relieve the stress on the locking member.

It is a further object of the invention to accomplish the above object in a flexible draw latch operated by a simple push-to-latch or lift-to-unlatch action.

These and other objects of the invention will become apparent upon a reading of the following detailed description of the invention with reference to the drawings, and the appended claims.

DETAILED DESCRIPTION OF THE INVENTION

Figure 1:
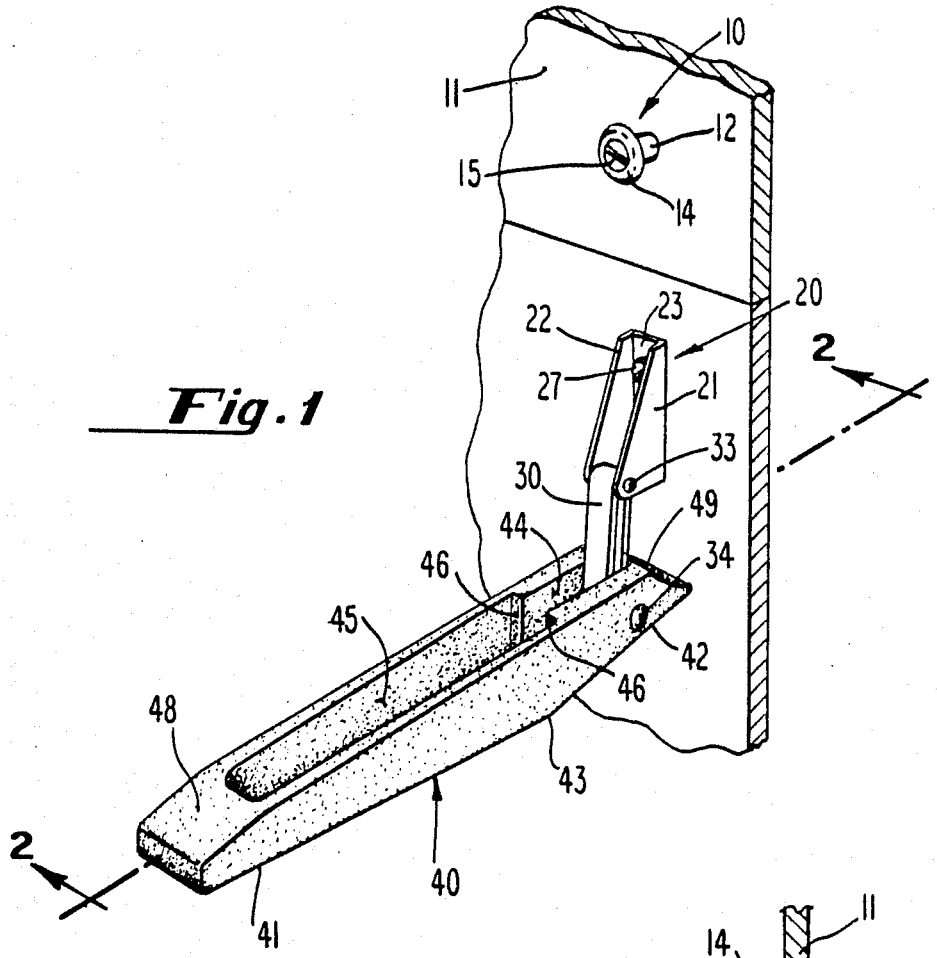
FIG. 1 is a perspective view of the present invention, as mounted to a pair of closure members, illustrated in the unlatched condition.
Figure 2:
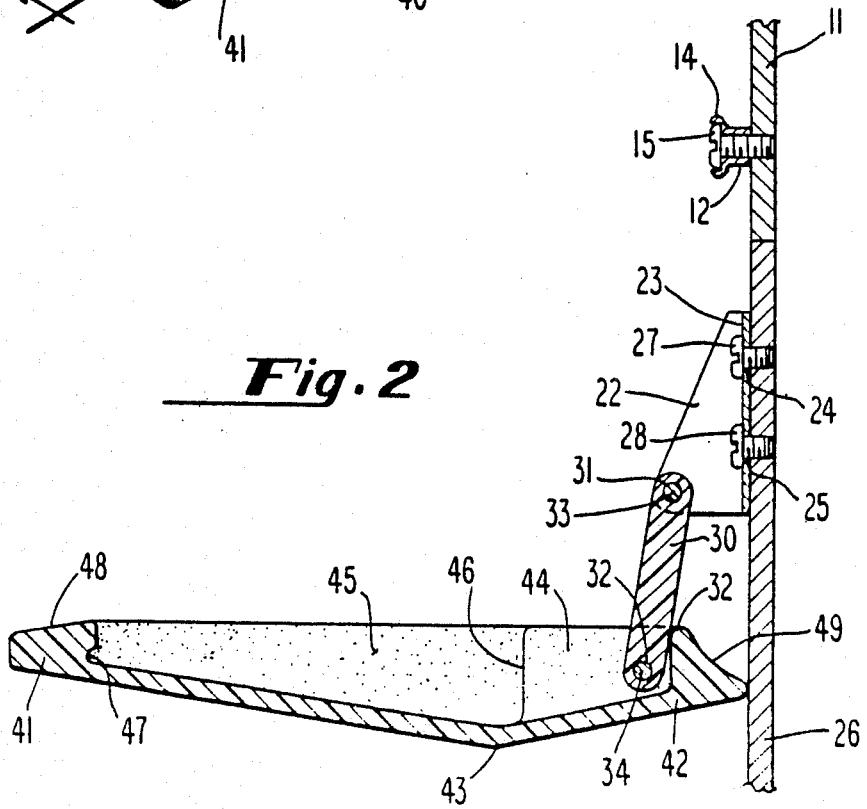
FIG. 2 is a sectional view of the invention taken along line 2—2 of FIG. 1.

With reference now being made to the Figures, particularly FIG. 1, the flexible over-center draw latch of the present invention comprises a keeper 10, a mounting bracket 20, a lever 30, and a locking member 40 which is made of a flexible, resilient material, preferably rubber. As seen in FIGS. 1 and 2, keeper 10 is adapted for being affixed to a closure member, such as panel 11, and comprises a cylindrical member 12 having a bore 13 therethrough and an outwardly extending annular flange 14 at the outer end of cylindrical member 12. As seen in the Figures, keeper 10 is affixed to panel 11 by a screw 15 or other suitable fastener disposed within the bore 13 of cylindrical member 12. With reference to FIG. 2, the annular flange 14 forms a seat for the head of screw 15 to provide a smooth exterior contour on the face of keeper 10, when assembled. In a preferred embodiment, keeper 10 is made of stamped metal construction.

Mounting bracket 20, as seen in FIGS. 1, is preferably a wedge-shaped member having spaced-apart opposing side walls 21,22 and a bottom wall 23. Bottom wall 23 is preferably provided with a pair of spaced-apart apertures 24,25 to facilitate the mounting of mounting bracket 20 to a closure member, such as panel 26, by screws 27,28 or other suitable fasteners. In a preferred embodiment, mounting bracket 20 is of a stamped metal construction, preferably stainless steel.

Lever 30, as seen in the Figures, comprises a bar having a transverse aperture 31,32 at the longitudinal ends thereof through which is disposed a pin 33,34 or the like to facilitate the pivotal mounting of lever 30 to mounting bracket 20 on the one end and locking member 40 on the other. Lever 30 is preferably of molded or extruded plastic construction. As seen in the Figures, lever 30 is mounted near the outer edges of side walls 21,22 of mounting bracket 20, whereby lever 30 is held in spaced relation to the face of panel 26.

Locking member 40, as mentioned previously, is preferably made of a rubber or other like material having sufficient flexibility and resilient properties. As seen in FIGS. 2–6, locking member 40 is preferably of substantially flattened triangular shape having a nose section 41, a tail section 42 and a crown 43 on the exterior face of locking member 40 intermediate the nose and tail sections. As seen in FIG. 1, the interior face of locking member 40 is provided with a relatively narrow channel 44 in tail section 42, which channel 44 is sized to substantially coincide with the width of lever 30 and to receive lever 30 therein when the latch is moved to a latched position (See FIG. 6). Extending from channel 44 toward nose section 41 is a channel 45 which, as seen in FIG. 1, is substantially longer and wider than channel 44, whereby a shoulder 46 is formed between the connection of the channels 44 and 45.

Figure 6:
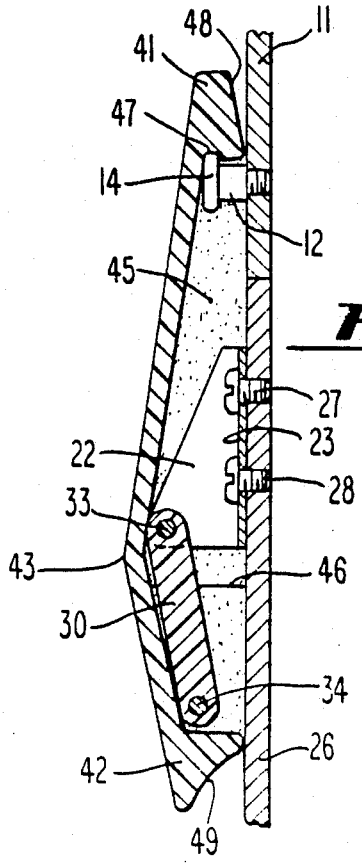
FIG. 6 is a sectional view taken along line 6—6 of FIG. 5.

As also seen in FIG. 1, channel 45 is widest at the point adjacent shoulder 46 and is sized so as to receive therein the mounting bracket 20 when the latch is moved to a latched position (See FIG. 6). From its widest point, channel 45 narrows slightly as it extends toward nose section 41, whereby the cross-sectional area of locking member 40 along channel 45 is constant. In this construction, the elongation or stretch of locking member 40 when the latch is closed is uniform to prevent the formation of "weak points" in the locking member and consequential localized deformation and fatigue of the resilient material. A notch 47 is provided at the end of channel 45 adjacent the nose section 41 (see FIG. 2) which is adapted to receive therein the annular flange 14 of keeper 10 when the latch is closed, as seen in FIGS. 4 and 6.

Figure 4:
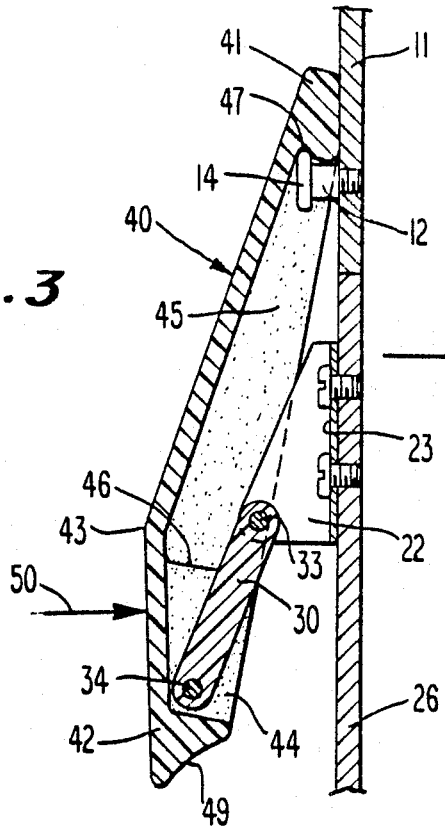
FIG. 4 is a sectional view taken along line 4—4 of FIG. 3.

The inner face 48 of nose section 41, as seen in the Figures, is beveled slightly outwardly and upwardly to facilitate the engagement of locking member 40 with the keeper 10 (see FIGS. 4 and 6). In one preferred embodiment, inner face 48 of nose section 41 forms a 10° angle with the vertical as illustrated in FIG. 6, which has been found to provide sufficient clearance for engaging keeper 10 and further to substantially prevent localized deformation and fatigue of the nose section 41 when the latch is closed.

The end of tail section 42 is provided with a concave surface 49 which facilitates the unlatching of the latch by an outward pull of tail section 42 away from panel 26, as described hereinbelow.

Figure 7:
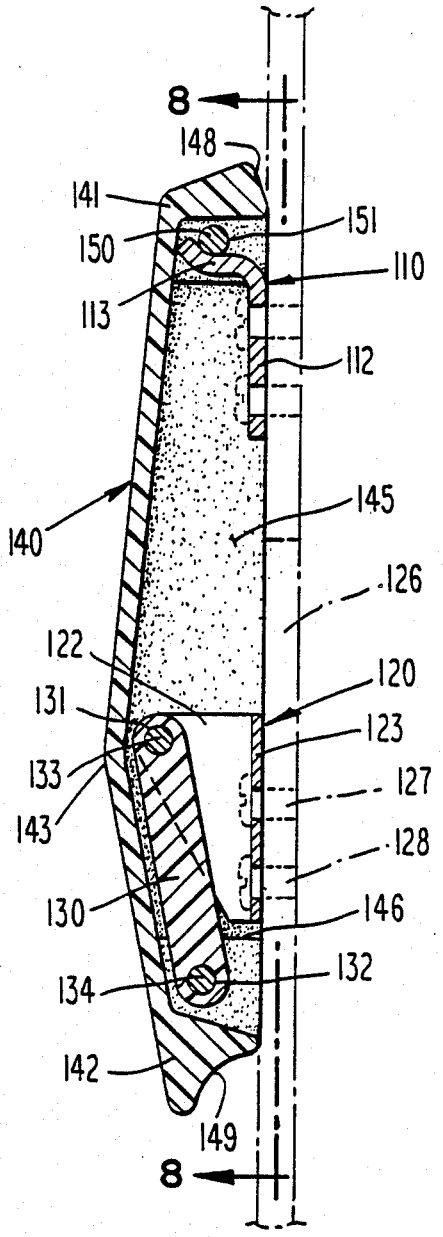
FIG. 7 is a sectional view similar to FIG. 6, showing the preferred embodiment of the invention in which the nose end of the locking member is provided with a transverse cross-pin.
Figure 8:
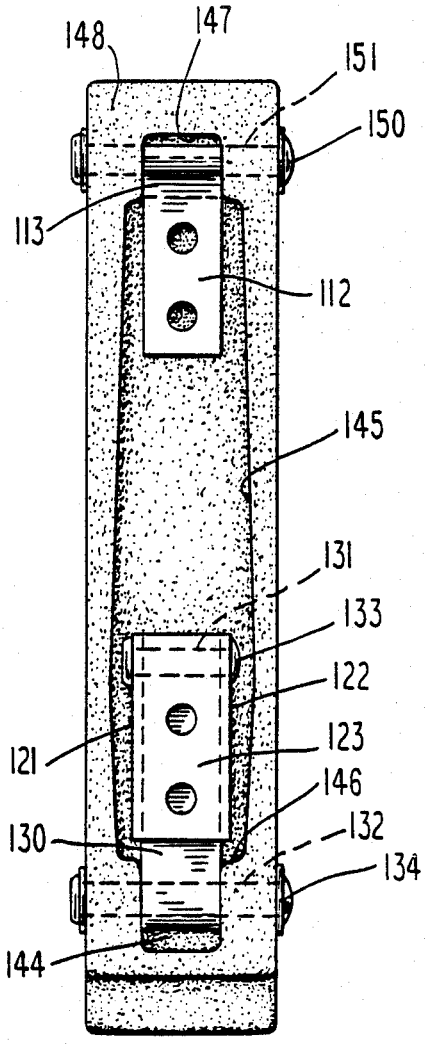
FIG. 8 is a rear elevational view of the preferred embodiment of the invention taken along line 8—8 of FIG. 7.

With reference to the preferred embodiment of the invention illustrated in FIGS. 7 and 8, the latch comprises a keeper 110 having a mounting region 112 and a curved leg region 113. The mounting region 112 is adapted for being affixed to panel 111 such as by screws or the like disposed within apertures in the mounting region 112. As seen in FIG. 7, curved leg region 113 is of an S-shaped configuration and is attached to the mounting region 112 so as to project, outwardly from panel 111.

A bracket 120 is also provided for mounting the latch to panel 126 and has the same shape and configuration as described above. That is, bracket 120 comprises a pair of spaced-apart side walls 121,122 and a bottom wall 123 which bottom wall 123 is adapted for being affixed to panel 126 by screws or the like 127,128. Lever 130 is pivotally connected to bracket 120 by pin 133 and is connected to tail section 142 of locking member 140 by pin 134 as described above in connection with the other embodiments. Locking member 140 is also of similar shape and design as above-described, having a channel 144 in tail end 142 thereof to accommodate lever 130 therein and a larger channel 145 adjoining channel 144 so as to form a shoulder 146. It should be noted that channels 144 and 145 are of slightly different configuration due to the reverse orientation of mounting bracket 120 in the preferred embodiment. (Compare FIG. 6 and FIG. 7) This reverse orientation of mounting bracket 120 as seen in FIG. 7 is desirable because it allows for mounting of bracket 120 farther away from the terminal edge of panel 126 without unnecessarily increasing the overall length of the latch.

The nose end 141 of locking member 140 is different in construction than the previous embodiments and is provided with a channel 147 therein which is sized so as to receive curved leg 113 of keeper 110 (see FIG. 8). Transversely disposed through nose end 141 and channel 147 is a bore 151 within which is disposed a pin 150. As seen in broken lines in FIG. 8, cross-pin 150 traverses channel 147 whereby it engages with curved leg 113 of keeper 110 when the latch is moved to a closed position, whereupon cross-pin 150 nests within a concave depression of S-shaped curved leg 113.

In the preferred embodiment, localized deformation at the nose end 141 of locking member 140 is virtually eliminated. In addition, the use of cross-pin 150 allows the locking member 140 to lie flat against the panel when in the latched condition for increased latching strength and better overall appearance.

The operation of the flexible over-center draw latch will now be described with reference to the sequential illustration thereof from a fully open, unlatched position (FIGS. 1 and 2) to a fully closed, latched condition (FIGS. 5 and 6), it being understood that the preferred embodiment illustrated in FIGS. 7 and 8 operates in a like manner.

Figure 3:
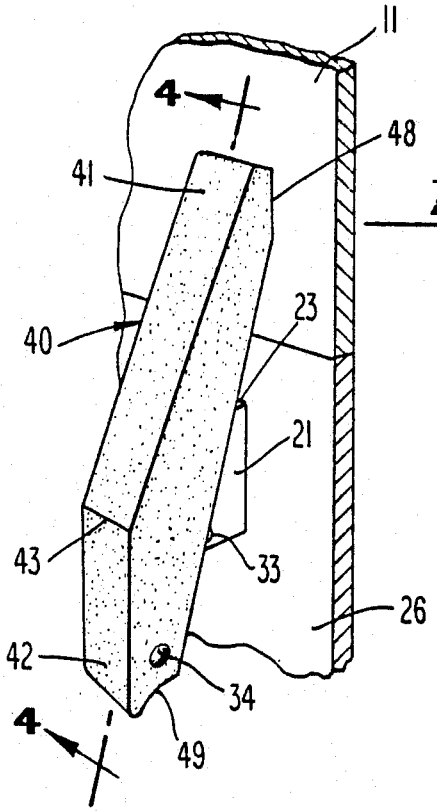
FIG. 3 is a perspective view of the invention illustrated in a partially latched condition.

From the fully open position of FIGS. 1 and 2, the locking member 40 is moved outwardly and upwardly and pivoted inwardly through lever 30 and pivot pins 33, 34 to the position illustrated in FIGS. 3 and 4 whereby the keeper 10 is received in the channel 45 and notch 47. From the position illustrated in FIGS. 3 and 4, the latch is closed by application of force to the locking member 40 in the direction of arrow 50 in FIG. 4. Upon movement of locking member 40 toward panel 26 to close the latch, lever 30 will pivot about pin 33 and locking member 40 will elongate slightly as the central axis of the latching force is reached. Once the lever 30 crosses the central axis, lever 30 will pivot about pins 33 and 34, and locking member 40 will contract and "snap" to the closed position of FIGS. 5 and 6 to provide positive over-center latching. The resiliency of the locking member 40 retains the panels 11 and 26 securely together.

To open the latch, the forefinger is placed against concave surface 49 on tail section 42 and the thumb is placed on the face of locking member 40 near the crown 43 and the latch is snapped open by a simple lifting and squeezing movement of the thumb and forefinger. From the resulting position of the latch illustrated in FIGS. 3 and 4, the locking member 40 is lifted to disengage the keeper 10 and the panels 11, 26 can be separated.

Figure 5:
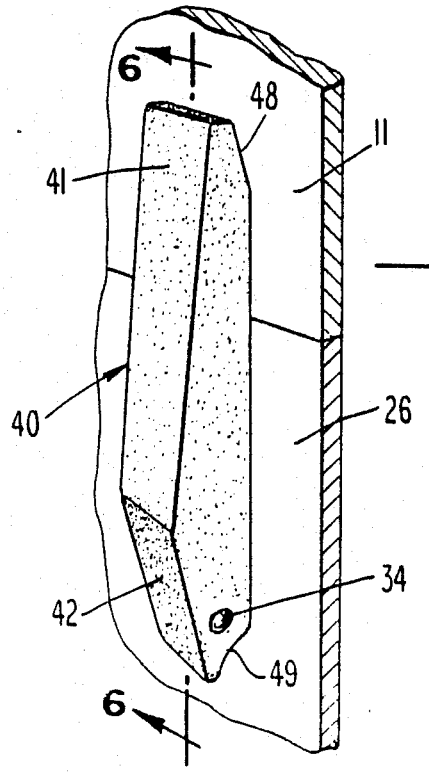
FIG. 5 is a perspective view of the invention illustrated in fully latched condition.

As seen in FIG. 5, the appearance of the latch when fully closed is a function of the shape and apperance of the locking member. Thus, locking member 40 can be made of any size or shape as may be considered desirable and furthermore may be of any color or colors, and the face thereof may be provided with a logo, trademark or other suitable indicia, as desired.

It can be seen from the above specification, the latch of the present invention, due to the presence of a flexible, resilient locking member, provides all of the advantages associated with flexible draw latches. For example, the flexibility of the locking member insures a positive latching action even if the mounting bracket and the keeper are not in precise alignment, and thus compensates for misalignment of the bracket and keeper during installation. In addition, the load or tension generated by the locking member can be varied, within a particular range, by simply increasing or decreasing the distance between the mounting bracket and the keeper to provide a lesser or greater degree of stretch in the locking member when the latch is closed. Of course, if the distance is too short the locking member will not properly engage the keeper and the latch will be ineffective. Likewise, if the distance is too large, the latch will tend to release spontaneously because the stretch capabilities of the locking member have been exceeded.

Preferred forms of the invention have been described and illustrated herein for purposes of illustration only and not for purposes of limitation, and various modifications or alternatives may suggest themselves to those skilled in the art, all of which are intended to be within the spirit and scope of the present invention as defined in the appended claims.

What is claimed is:

1. An over-center draw latch for use in securing two closure members together, comprising:

(a) a keeper adapted to be affixed to a first closure member;

(b) a mounting bracket adapted to be affixed to a second closure member;

(c) a lever pivotally connected to said mounting bracket;

(d) a locking member pivotally connected to said lever, said locking member having a nose section generally opposite said pivot connection with said lever, said nose section having a member transversely disposed therethrough and positioned to detachably engage said keeper;

(e) said locking member having an upper wall and a pair of opposing side walls depending from said upper wall, said locking member being of such size and shape so as to envelop and conceal the keeper, the mounting bracket and the lever when the latch is in a closed, latched position;

(f) wherein said locking member is made of an elastomeric material which is flexible and resilient relative to the keeper, the mounting bracket and the lever;

(g) wherein the relative flexibility and resiliency of the locking member permits misaligned latching engagement of the locking member when the keeper and the mounting bracket are misaligned; and (h) wherein said pivot connections between the lever and the mounting bracket and the lever and the locking member are located at opposite ends of said lever, whereby upon movement of said locking member to said closed position, said locking member is stretched to an elongate condition and then contracts when said locking member is in a fully closed position.

2. The latch of claim 1, wherein said elastomeric material is rubber.

3. The latch of claim 1, wherein said locking member is provided with a first channel therein adapted to receive said lever when said locking member is moved to said closed position, and a second channel adjacent to said first channel adapted to receive said mounting bracket therein when said locking member is moved to said closed position, and a third channel adjacent to said second channel and adapted to receive said keeper therein when said locking member is moved to said closed position, wherein said second channel is substantially longer and wider than said first channel, wherein said second channel substantially corresponds to the width of said mounting bracket; and wherein said first channel substantially corresponds to the width of said lever; and wherein said third channel substantially corresponds to the width of said keeper.

4. The latch of claim 3, wherein the cross-sectional area of said elastomeric material is constant only along the length of said second channel.

5. The latch of claim 1, wherein said mounting bracket comprises a wedge-shaped member having a bottom wall adapted to receive fastening means for affixing said bracket to a second closure member and a pair of spaced-apart walls outwardly extending from said bottom wall, wherein said lever is disposed between said side walls and connected thereto by a pin in spaced relation to said bottom wall.

6. The latch of claim 1, wherein said keeper comprises a substantially straight mounting region adapted for affixing said keeper to a first closure member and an S-shaped leg attached to said mounting region and extending therefrom, said S-shaped leg comprising means for detachably engaging said transverse member of said locking member.

7. The latch of claim 1, wherein said locking member further comprises a tail portion to which said lever is connected, said tail portion having a concave surface to facilitate movement of said locking member to an unlatched position.

8. An over-center draw latch for use in securing two closure members together, comprising:

(a) a keeper adapted to be affixed to a first closure member;

(b) a mounting bracket adapted to be affixed to a second closure member, said mounting bracket having a bottom wall and a pair of spaced-apart side walls extending from said bottom wall;

(c) a lever disposed between said spaced-apart side walls of said mounting bracket and pivotally connected thereto at a location spaced from said bottom wall of said mounting bracket;

(d) a locking member pivotally connected to said lever, said locking member having a nose section generally opposite said pivot connection with said lever, said nose section having a member transversely disposed therethrough and positioned to detachably engage said keeper;

(e) said locking member having an upper wall and a pair of opposing side walls depending from said upper wall, said locking member being of such size and shape so as to envelop and conceal the keeper, the mounting bracket and the lever when the latch is in a closed, latched position;

(f) wherein said locking member is made of an elastomeric material which is flexible and resilient relative to the keeper, the mounting bracket and the lever;

(g) wherein the relative flexibility and resiliency of the locking member permits misaligned latching engagement of the locking member when the keeper and the mounting bracket are misaligned; and (h) wherein said pivot connections between the lever and the mounting bracket and the lever and the locking member are located at opposite ends of said lever, whereby upon movement of said locking member to said closed position, said locking member is stretched to an elongate condition and then contracts when said locking member is in a fully closed position.

9. The latch of claim 8, wherein said elastomeric material is rubber.

10. The latch of claim 8, wherein said locking member is provided with a first channel adapted to receive said lever therein when said locking member is moved to said closed position, a second channel adjacent said first channel adapted to receive said mounting bracket therein when said locking member is moved to said closed position, and a third channel adjacent to said second channel adapted to receive said keeper therein when said locking member is moved to said closed position, wherein said second channel is substantially longer and wider than said first channel wherein said second channel substantially corresponds to the width of said mounting bracket, wherein said first channel substantially corresponds to the width of said lever, and wherein said third channel substantially corresponds to the width of said keeper.

11. The latch of claim 10, wherein the cross-sectional area of said elastomeric material is constant only along the length of said second channel.

12. An over-center draw latch in combination with two relatively movable closure members, comprising:

(a) a keeper affixed to a first closure member, said keeper comprising a substantially straight mounting region and an S-shape leg attached to said mounting region and extending therefrom;

(b) a wedge-shaped mounting bracket having a bottom wall and a pair of spaced-apart side walls outwardly extending from said bottom wall, wherein said bottom wall of said mounting bracket is adjacent to a second closure member and is affixed thereto;

(c) a lever disposed between said spaced-apart side walls of said mounting bracket and pivotally connected thereto at a location spaced from said bottom wall and said second closure member;

(d) a locking member having a nose section, a tail section and a body disposed between said nose section and said tail section, said tail section being pivotally connected to said lever, said nose section having a transverse pin disposed therethrough and adapted to detachably engage said S-shaped leg of said keeper;

(e) said locking member having a top wall and a pair of opposing side walls depending from said top wall, said locking member being of such size and shape so as to envelop and conceal the keeper, the mounting bracket and the lever when the latch is in a closed, latched position;

(f) said locking member having a first channel therein in the tail section thereof which is adapted to receive said lever as the locking member is moved to a closed position, said first channel substantially corresponding to the width of said lever, a second channel in the body of said locking member, said second channel being disposed adjacent said first channel and extending towards said nose section, said second channel being adapted to receive said mounting bracket therein as the locking member is moved to a closed position, said second channel substantially corresponding to the width of said mounting bracket, said second channel being substantially longer and wider than said first channel, and a third channel in the nose section of said locking member, said third channel being disposed adjacent said second channel, said third channel being adapted to receive said keeper therein the locking member is moved to a closed position, said third channel substantially corresponding to the width of said keeper;

(g) wherein said locking member is made of an elastomeric material which is flexible and resilient relative to the keeper, the mounting bracket and the lever;

(h) wherein the relative flexibility and resiliency of the locking member permits misaligned latching engagement of the locking member when the keeper and the mounting bracket are misaligned;

(i) wherein the cross-sectional area of said elastomeric material is constant only along the length of said second channel; and (j) wherein said pivot connections between the lever and the mounting bracket and the lever and the locking member are located at opposite ends of said lever, whereby upon movement of said locking member to said closed position, said locking member is stretched to an elongate condition and then contracts when said locking member is in a fully closed position.

13. The latch of claim 12, wherein said tail section of said locking member is provided with a concave surface to facilitate the lifting of said locking member and the unlatching of said latch.

14. The latch of claim 12, wherein said elastomeric material is rubber.

15. The latch of claim 1, wherein the locking member is under a tensile load when in the latched condition and wherein the tensile load can be varied by variably displacing said keeper relative to said mounting bracket.

16. The latch of claim 8, wherein the locking member is under a tensile load when in the latched condition and wherein the tensile load can be varied by variably displacing said keeper relative to said mounting bracket.

17. The latch of claim 12, wherein the locking member is under a tensile load when in the latched condition and wherein the tensile load can be varied by variably displacing said keeper relative to said mounting bracket.

* * * * *